US008621974B1

(12) United States Patent
Chamberlain et al.

(10) Patent No.: US 8,621,974 B1
(45) Date of Patent: Jan. 7, 2014

(54) MODULAR OVER PRESSURE DISRUPTER

(75) Inventors: Keith Chamberlain, Indian Head, MD (US); William Transue, Indian Head, MD (US); Jude Wieczorek, Indian Head, MD (US); Robert Hutcheson, Jr., Indian Head, MD (US); Ferrell Furr, Indian Head, MD (US); Aaron Chan, Indian Head, MD (US); William Myers, Indian Head, MD (US); Scott Walthour, Indian Head, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 19 days.

(21) Appl. No.: 13/506,575

(22) Filed: Apr. 30, 2012

(51) Int. Cl.

| | |
|---|---|
| ***F42B 33/06*** | (2006.01) |
| ***F42B 12/46*** | (2006.01) |
| ***A62C 8/00*** | (2006.01) |
| ***A62C 99/00*** | (2010.01) |

(52) U.S. Cl.
USPC ..... 86/50; 102/367; 169/36

(58) Field of Classification Search
USPC ..... 86/50; 102/367, 368, 369; 169/36, 54
See application file for complete search history.

(56) References Cited

U.S. PATENT DOCUMENTS

| | | | | |
|---|---|---|---|---|
| 1,989,097 | A * | 1/1935 | Jones | 169/30 |
| 2,349,980 | A * | 5/1944 | Moore | 102/382 |
| 2,873,806 | A * | 2/1959 | Bittner | 169/36 |
| 3,482,637 | A * | 12/1969 | Mitchell et al. | 169/45 |
| 3,833,063 | A * | 9/1974 | Williams | 169/28 |
| 3,833,064 | A * | 9/1974 | Ranney, Jr. | 169/52 |
| 3,980,139 | A * | 9/1976 | Kirk | 169/28 |
| 4,285,403 | A * | 8/1981 | Poland | 169/28 |
| 4,616,565 | A | 10/1986 | Reinovsky | |
| 6,012,531 | A * | 1/2000 | Ryan | 169/36 |
| 6,796,382 | B2 * | 9/2004 | Kaimart | 169/43 |
| 7,210,409 | B2 | 5/2007 | Johnson | |
| 7,261,165 | B1 | 8/2007 | Black | |
| 7,581,478 | B2 | 9/2009 | Lacombe et al. | |
| 7,896,092 | B2 * | 3/2011 | Hernandez Reina | 169/28 |
| 2004/0244628 | A1 * | 12/2004 | O'Dwyer et al. | 102/480 |
| 2005/0139363 | A1 * | 6/2005 | Thomas | 169/30 |
| 2007/0007021 | A1 * | 1/2007 | Regan | 169/84 |
| 2008/0282874 | A1 * | 11/2008 | Ogden et al. | 86/50 |

OTHER PUBLICATIONS

U.S. Appl. No. 11/593,947, filed Feb. 7, 2008, Dennis Eugene Wilson.
U.S. Appl. No. 11/160,814, filed Jan. 11, 2007, Colin Regan.

* cited by examiner

*Primary Examiner* — Bret Hayes
(74) *Attorney, Agent, or Firm* — Fredric J. Zimmerman

(57) ABSTRACT

In an exemplary embodiment, an overpressure disrupter system is described including at least one module, an explosive material contained in at least one module, and a fire retardant material contained in at least one module. At least one module includes at least one connection area, at least one outer wall; and at least one inner wall. At least one outer wall and at least one inner wall combine to form at least one outer compartments housing the fire retardant material. At least one inner wall forms at least one inner compartment housing the explosive material. At least one connection area is configured to connect at least one module with at least one of another of at least one module and at least one ancillary device.

16 Claims, 7 Drawing Sheets

MODULAR OVER PRESSURE DISRUPTER

STATEMENT OF GOVERNMENT INTEREST

The embodiments of the invention described herein may be manufactured and used by or for the Government of the United States of America for governmental purposes without the payment of any royalties thereon or therefor.

BACKGROUND

The subject matter described herein relates to over pressure disrupters for use in explosives disposal, such as vehicle born improvised explosive devices (VBIEDs). Explosives disposal involves neutralizing or otherwise removing explosives with a minimum amount of damage. Explosives disposal is necessary in many situations, such as for example with handling improvised explosive devices (IEDs). Over pressure disruption is a technique in which the fusing of an IED, such as electronic fusing, is disrupted by introducing pressure, such as into a compartment or interior of a vehicle. The aim of using an over pressure disrupter is to prohibit the IED from detonating. Existing over pressure disrupters such as Maxi-Candle®, Slim Jim® and Bottler disrupters have limitations, as described further herein.

SUMMARY OF THE INVENTION

One aspect of the invention provides an overpressure disrupter system including: one or more modules; an explosive material contained in one or more modules; and a fire retardant material contained in one or more modules; one or more modules further comprising: one or more connection areas; one or more outer walls; and one or more inner walls. One or more outer walls and one or more inner walls combine to form one or more outer compartments housing the fire retardant material. One or more inner walls form one or more inner compartments housing the explosive material. One or more connection areas are configured to connect one or more of the one or more modules with one or more of: another of the one or more modules, and one or more ancillary devices.

Another aspect of the invention provides an overpressure disrupter system including: two or more connectable modules; an explosive material contained is the two or more connectable modules; and a fire retardant powder contained in the two or more connectable modules. The two or more connectable modules connect via standardized connector areas contained within each of the two or more connectable modules. The fire retardant powder is disposed within the two or more connectable modules to encompass, substantially, the explosive material.

A further aspect of the invention provides an over pressure disrupter system including: a series of connected modules connected via a plurality of connection areas. The series of connected modules each comprise an explosive charge substantially surrounded with a fire retardant material. The fire retardant material is substantially surrounded by a polycarbonate outer shell, and one or more detonators connected to one or more of the plurality of connection areas.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description. The scope of the invention will be pointed out in the appended claims.

DETAILED DESCRIPTION OF EXEMPLARY EMBODIMENTS OF THE INVENTION

Figure 1:
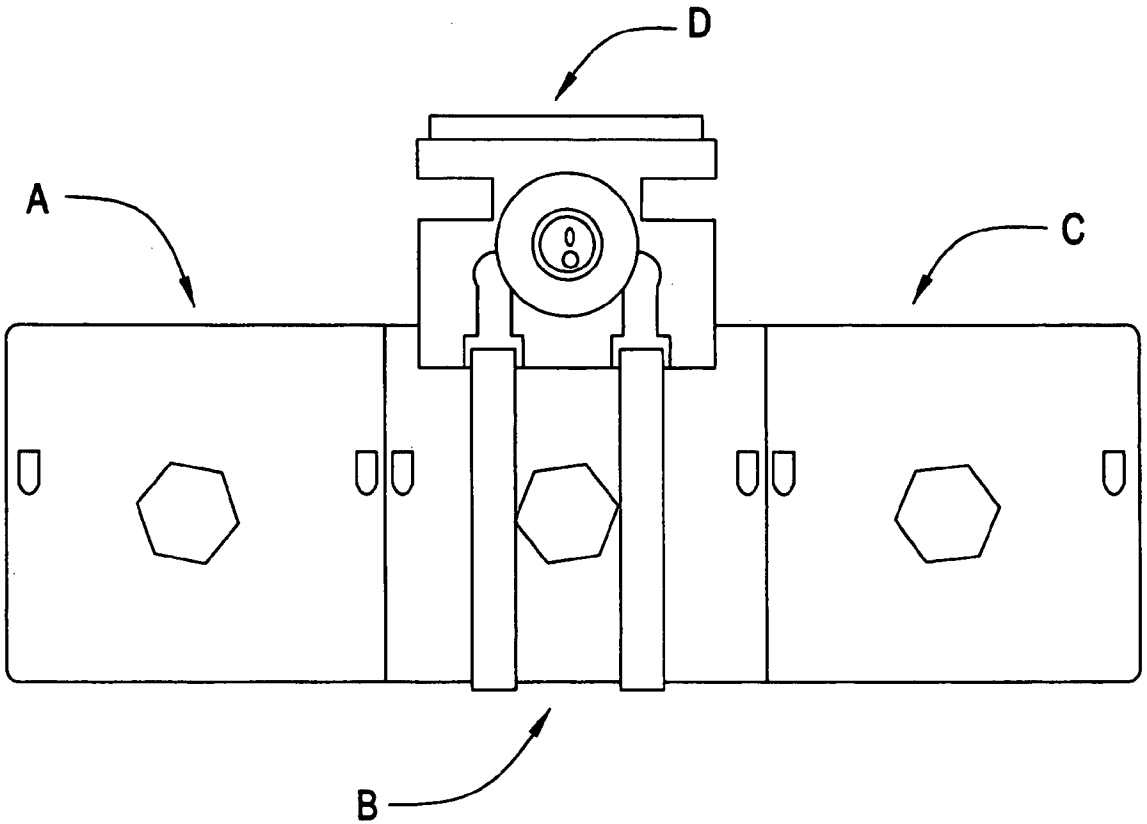
FIG. 1 illustrates a front view of an example overpressure disrupter system.

It will be readily understood that the components of the embodiments, as generally described herein, may be arranged differently from the described example embodiments. Thus, the following more detailed description of the example embodiments is not intended to limit the scope of the claims, but is merely representative of those embodiments.

Reference throughout this specification to "embodiment (s)" (or the like) means that a particular feature, structure, or characteristic described in connection with the embodiment is included in at least one embodiment. Thus, appearances of the phrases "according to embodiments" or "an embodiment" (or the like) in various places throughout this specification are not necessarily all referring to the same embodiment.

Furthermore, the described features, structures, or characteristics may be combined in any suitable manner in one or more embodiments. In the following description, numerous specific details are provided, to give a thorough understanding of example embodiments. One skilled in the relevant art will recognize, however, that aspects can be practiced without one or more of the specific details, or with other methods, components, materials, et cetera. In other instances, well-known structures, materials, or operations are not shown or described in detail to avoid obfuscation.

An over pressure disrupter system to disrupt electronic fusing may be used for deactivating vehicle born improvised explosive devices (VBIEDs). An over pressure disrupter system aims to increase the pressure, such as within a vehicle compartment, in order to disable a VBIED. However, existing systems have some drawbacks, including catching components (such as internal components of the vehicle, for example a seat or a dashboard) on fire when detonated. Existing overpressure disruption systems include Maxi-Candle®, Slim Jim® and Bottler.

Existing systems have a high probability of fire (such as in the compartment of the vehicle) if the over pressure disrupter charge (or particles heated thereby) comes in contact with the compartment interior. This hazard is likely because existing systems either use no fire retardant material or utilize water, which is unsuitable for operating/storage at various temperatures. Additionally, existing systems lack modularity (the charges can not be readily connected together and require separate blasting caps for each charge used). Moreover, existing systems do not provide ancillary devices or sub-components that make use more convenient, such as an incorporated window breaker or robotic gripper block, making deployment and use of existing systems difficult.

Accordingly, an embodiment provides an overpressure disrupter. An embodiment may be implemented for example as a vehicle modular overpressure disrupter (VMOD) system providing overpressure to disrupt electronic fusing used with vehicle born improvised explosive devices (VBIEDs). According to an embodiment, a VMOD system is modular, for example comprised of three explosive modules. The explosive modules may be used individually or connected together. The VMOD system may include other modules, ancillary devices such as detonators, incorporated window breaker, and/or robotic gripper block.

The description now turns to the figures. The illustrated example embodiments will be best understood by reference to the figures. The following description is intended only by way of example and simply illustrates certain example embodiments representative of the invention, as claimed.

Referring to FIG. 1, an example VMOD system is illustrated. In the example illustrated in FIG. 1, three explosive modules A, B, and C are shown. The explosive modules A, B, and C may be connected using a variety of connection techniques. For example, explosive module A may be connected to explosive module B, which is in turn connected to explosive module C, via threading such that the explosive modules A, B, and C form a modular system. Each interface or connection, such as between explosive module A and explosive module B, or between explosive module B and explosive module C, may include an appropriate material, such as an explosive to permit detonation of any explosive module selected form A, B, and/or C (provide detonation of any connected modules, whether connected directly to the initiated module or indirectly connected thereto). Connections may also be plugged, as shown in FIG. 1 with hexagonal bolts at the end of the plugs, and filled with another material, such as fire retardant material, as further described herein. In one example, booster/connector(s) (described further herein) may be used to connect the modules to facilitate detonation of each connected explosive module (here, explosive modules A, B, and C), to connect ancillary devices, and/or as plugs filled with fire retardant material.

Figure 2:
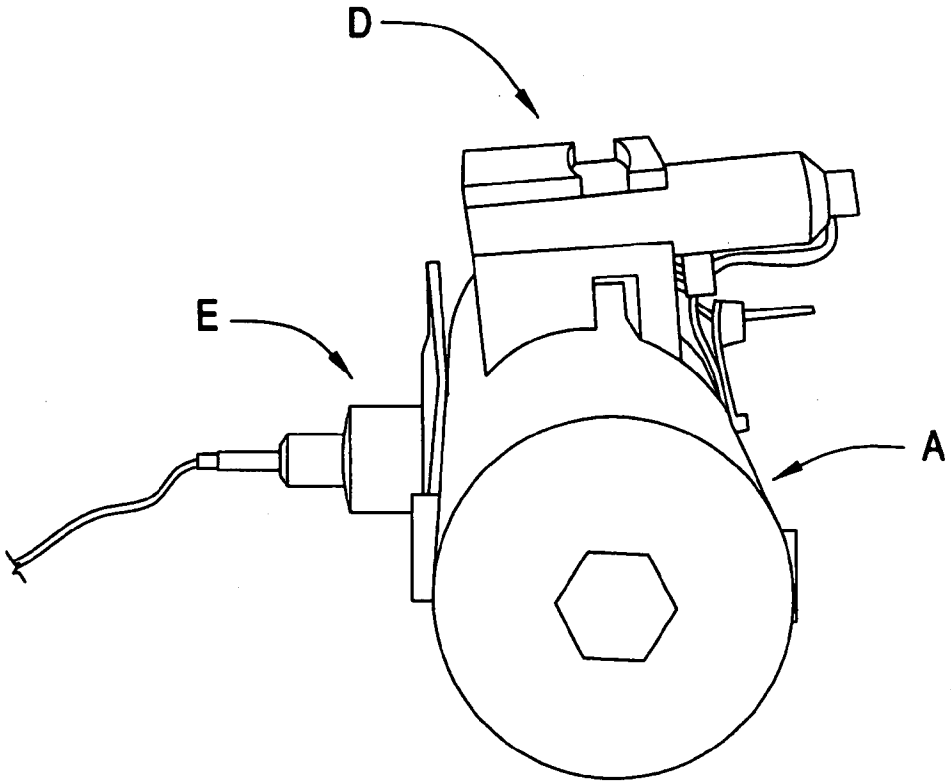
FIG. 2 illustrates a side view of an example overpressure disrupter system.

The example VMOD system illustrated in FIGS. 1-2 may include ancillary device(s), such as ancillary devices D and E. An ancillary device may be one device or a plurality of integrated devices. Moreover, there may be more than one ancillary device included, as described in connection with FIG. 2. As illustrated in FIG. 1, the ancillary device D is located atop explosive module B, and provides both a robotic gripper such that it can be handled and manipulated robotically, such as for placement within a vehicle's passenger compartment, and a window breaker such as to facilitate entry and placement of VMOD system within a compartment, such as a vehicle's passenger compartment.

In FIG. 2, which is a side view of FIG. 1, another ancillary device, E, is illustrated as connected to one of the explosive modules (the center explosive module in this example—corresponding to explosive module B in FIG. 1). The ancillary device E provides an initiation charge to detonate the explosive module to which it is connected. For example, the ancillary device E may be a blasting cap modified to connect to the center explosive module, as for example by threads allowing it to be screwed into the center explosive module via an adapter, as further described herein. It should be noted that ancillary device(s) may be connected to other explosive modules or components of a VMOD system in addition to the illustrated, representative examples illustrated in the figures.

Figure 3A:
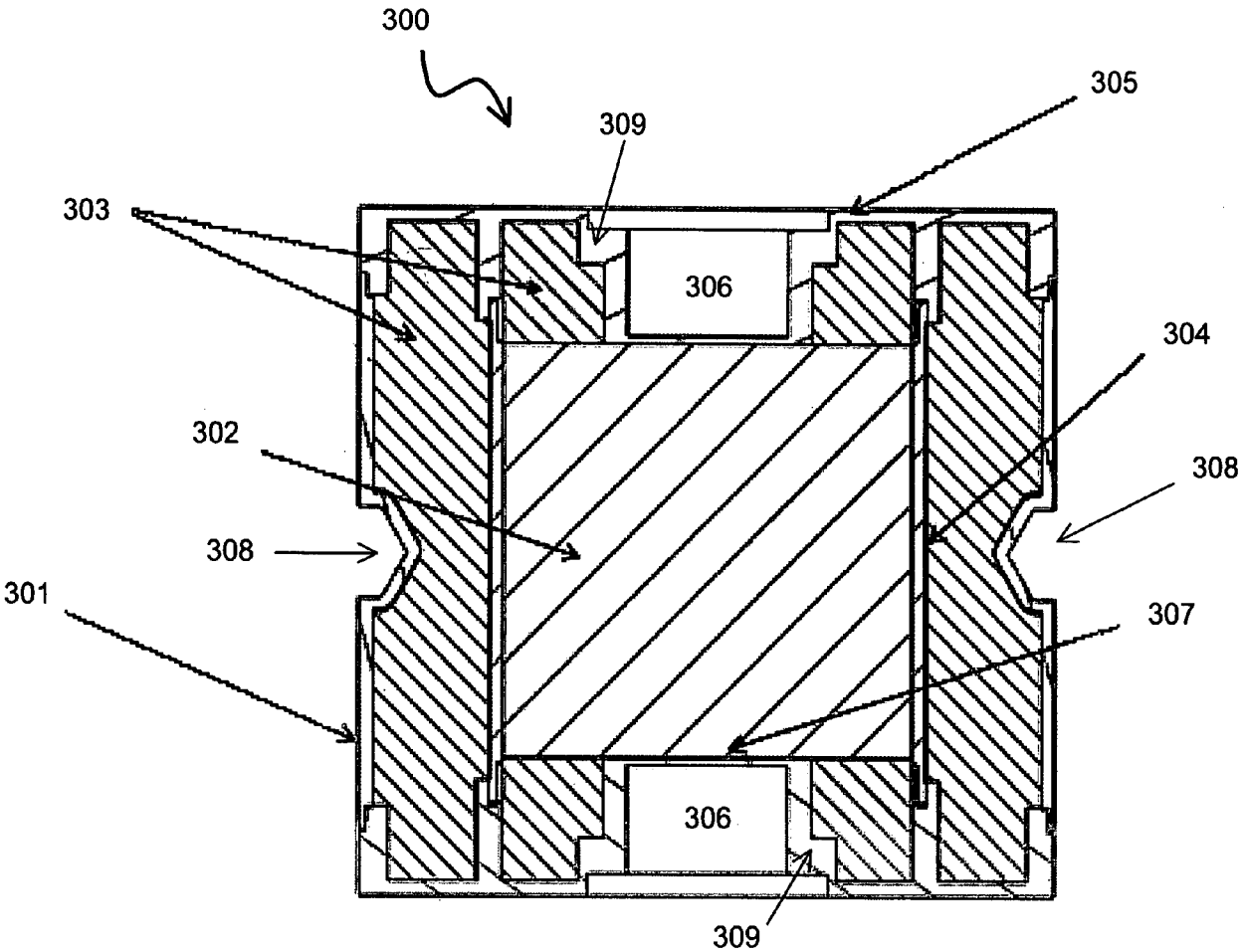
FIG. 3A illustrates a cross section of an exemplary embodiment of a module.
Figure 3B:
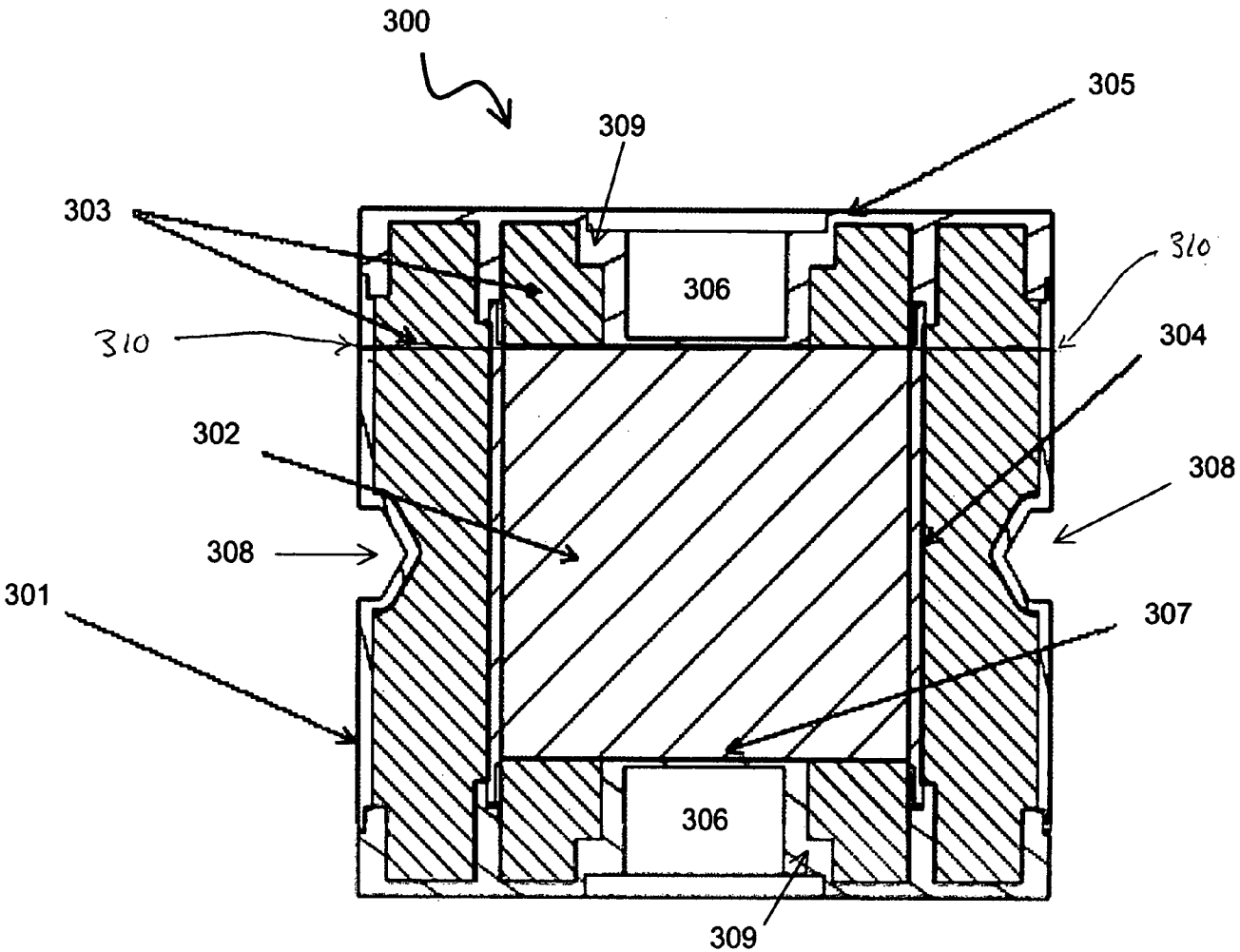
FIG. 3B illustrates a cross section of another exemplary embodiment of a module.

Referring to FIG. 3A, a cross section of an explosive module 300 is illustrated. The explosive module 300 illustrated in FIG. 3A may be any of explosive modules A-C of FIG. 1. As illustrated, the explosive module 300 has an outer cylinder wall 301 (which may be of another shape, according to the implementation chosen). In an exemplary embodiment referring to FIG. 3A, the outer cylinder wall 301 may be a single, continuous structure. In another exemplary embodiment referring to FIG. 3B, the outer cylinder wall 301 may be a structure formed from two, separate pieces of material that snap or lock together. The outer cylinder wall 301 may be made of polycarbonate plastic, such as LEXAN® 1414, or some other plastic. For use in military theater operations, the outer cylinder wall 301 may be made of a material that is highly resistant to extreme temperature changes, though in many situations this will not be a requirement. The explosive module 300 contains a main explosive charge 302, which may be selected based on the particular implementation and characteristics desired, such as a main explosive charge of PBXN-11, PBXN-9, PBXN-114, or PBXW-115 for handling VBIEDs.

A fire retardant material 303 may surround the main explosive charge 302, for example ABC fire retardant powder (including ammonium phosphate). The module 300, in an exemplary embodiment, may be sized as about 4 inches in length by about 4 inches in diameter. The fire retardant material 303 fills one or more cavities such that it surrounds the main explosive charge 302. The fire retardant material 303 is selected and placed such that it functions to reduce the flame and heat damage, and minimizes the propagation of the flame of the main charge 302 to surrounding materials that will inevitably result from the detonation of the main charge 302. Thus, the fire retardant material 303 functions to minimize heat and burn damage responsive to detonation of the main explosive charge 302. In an exemplary embodiment referring to FIG. 3A, the fire retardant material 303 is continuous throughout a length of the adjacent outer cylinder wall 301. In another exemplary embodiment referring to FIG. 3B, the fire retardant material 303 is composed of two separate sections separated by a membrane 310, such as, a plastic membrane, while being adjacent a length of the adjacent outer cylinder wall 301.

An inner wall 304, such as an inner cylindrical wall, may be utilized to enclose the main explosive charge 302 and keep it separate from the fire retardant material 303. The inner wall 304 may be comprised of the same material as the outer cylindrical wall 301. End cap(s) 305 may be placed into connection areas 306 of the module 300. The end cap(s) 305 may be comprised of the same material as the outer cylindrical wall 301. The end cap(s) 305 occupy a space, such as a ridge defined in the connection area 306 of the module such that a connection area 306 may be closed off. End cap(s) may be used to contain a filling material, such as a fire retardant material 303, as further described herein, within the connection areas 306. The connection areas 306, when a module 300 is to be connected to another module or an ancillary device, as illustrated in FIGS. 1-2, may not contain end cap(s) 305. The connection area(s) 306 may be configured for convenient connection with another module or an ancillary device, such as by having threads therein, as described further herein. The connector area(s) may be formed to include booster well(s) 309 for accepting a separate connecting piece (described further herein) that forms a connection between modules and/or modules and ancillary device(s).

Module 300 may also contain one or more inner seals (one is indicated at 307) that may be used to separate a main charge 302 from other components or areas of the module, such as a connection area 306 containing fire retardant material 303. The seal(s) may be comprised of the same material chose for the outer cylinder wall 301, and may be fixed in place, as for example with a two-part epoxy. Module 300 may also contain additional features to facilitate additional functionality. For example, module 300 illustrated in FIG. 3 includes indents 308 for attaching an ancillary device, such as attachment of ancillary device D via ring clamps.

The choice of shape for a module 300 may be dictated by the desired outcome. For example, where increased fire suppression is desirable, choice of a cylindrical shape for a module 300 affords a coating of fire retardant material 303 that coats surrounding structures, such as a car seat in a vehicle compartment, and helps extinguish the flame front, responsive to detonation of the main charge 302. For example, with a cylindrical shape, the fireball duration from the main charge from a module may be reduced to about 7 ms, as compared with fireball duration of about 140 ms when no fire retardant is used in a similarly shaped module. Thus, cylindrical modules in combination with use of fire retardant material may be utilized to essential eliminate the flame front from the explosion and provide an explosion essentially free from fire/burning.

A cylindrical structure, as illustrated in FIGS. 1-3, also provides for convenient connection of modules to one another, and of module(s) to ancillary devices, as further described herein. It should be noted however, that other shapes and configurations of a module may be chosen and/or modules having different shapes and configurations in the same system may be desirable in some circumstances, such as addition of different ancillary devices to different modules.

Figure 4A:
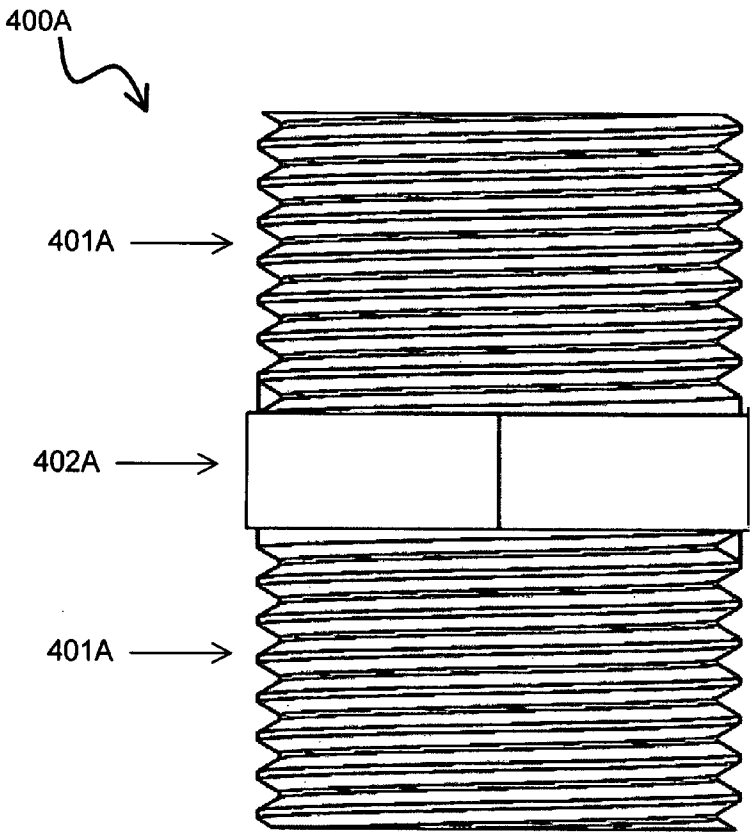
FIG. 4A illustrates an example additional connection piece.

As illustrated in FIG. 1, the system may be modular in that the explosive modules may be linked together or connected in an appropriate number and configuration for a given circumstance. Referring to FIG. 4A, a connection piece, such as a separate booster/connector 400A, which may have a hollow cavity or interior and be filled with an explosive charge or fire retardant material, may be used to connect modules, such as explosive modules A-C of FIG. 1, or modules and ancillary devices together. The explosive charge may be the same as used in the main charge 302, or another appropriate material such that detonation of one explosive module, for example explosive module B of FIG. 1, facilitates detonation of other explosive module(s), such as explosive modules A and C of FIG. 1.

A standard connection piece, such as booster/connector 401A supplied with the VMODS may be designed to initiate and/or connect modules. For example a standard connection piece allows connection of either an explosive module to another explosive module, or to an ancillary device such as ancillary device E of FIG. 2, which may be a blasting cap modified to connect to an explosive module via the connecting piece. A booster/connector 400A alone can also be used to link one module to another. In this manner, the connector's 400A explosive fill propagates the detonation wave to the subsequent modules. As an example, for a system having modules of the example size noted above, connectors 400A connecting such modules may contain an explosive fill material of approximately 18 grams, which may consist of PBXN 11 or the like.

A booster/connector 400A may have a shape and function similar to that of a pipe nipple, and be threaded 401A on both ends around a central portion 402A such that it may interface with (for example, be screwed into) threaded connector area (s) 306 (or wells thereof 309) of an explosive module (or corresponding connector area of an ancillary device). The threads may thus anchor the booster/connector 400A into one of the booster wells 309 on the side or the end of the module. It should be noted that the example connector areas 306 and connection piece 400A, as with other components of the module 300, may take a variety of forms, including for example having male and female connector area(s) formed in modules/ancillary devices at some locations such that an additional connection piece is not needed.

Figure 4B:
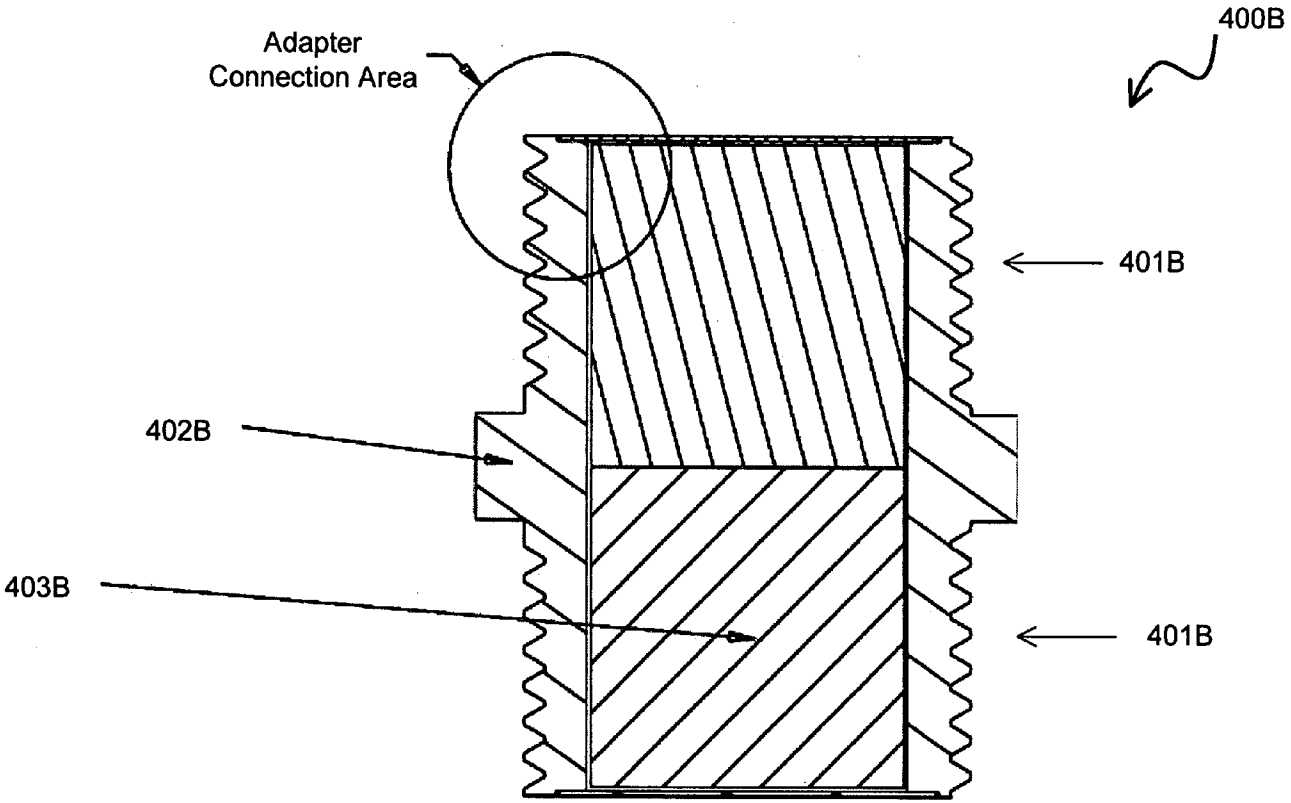
FIG. 4B illustrates a cross section of an additional connection piece.

Referring to FIG. 4B, an example cross section of a booster/connector 400B is illustrated. Again threaded portions 401B are illustrated along with center portion 402B. Here, booster/connector 400B acts as a container for fill material 403B, which may be selected as desired. For example, fill material 403B may be comprised of an explosive material, such as PBNX-11, when booster/connector 400B acts to connect two explosive modules, such as modules A, B, and C of FIG. 1. Alternatively, fill material 403B may be composed of a fire retardant material, such as ammonium phosphate, when booster/connector 403B acts to plug a non-connected connection area of a module (such as illustrated in FIGS. 1-2 with hexagonal bolts at the end of the plugs, not illustrated in FIG. 4A-B). Booster/connector 400B may also server as a connection point for an adapter, such as an adapter for connecting an ancillary device, such as ancillary device E, as further described herein.

Figure 5:
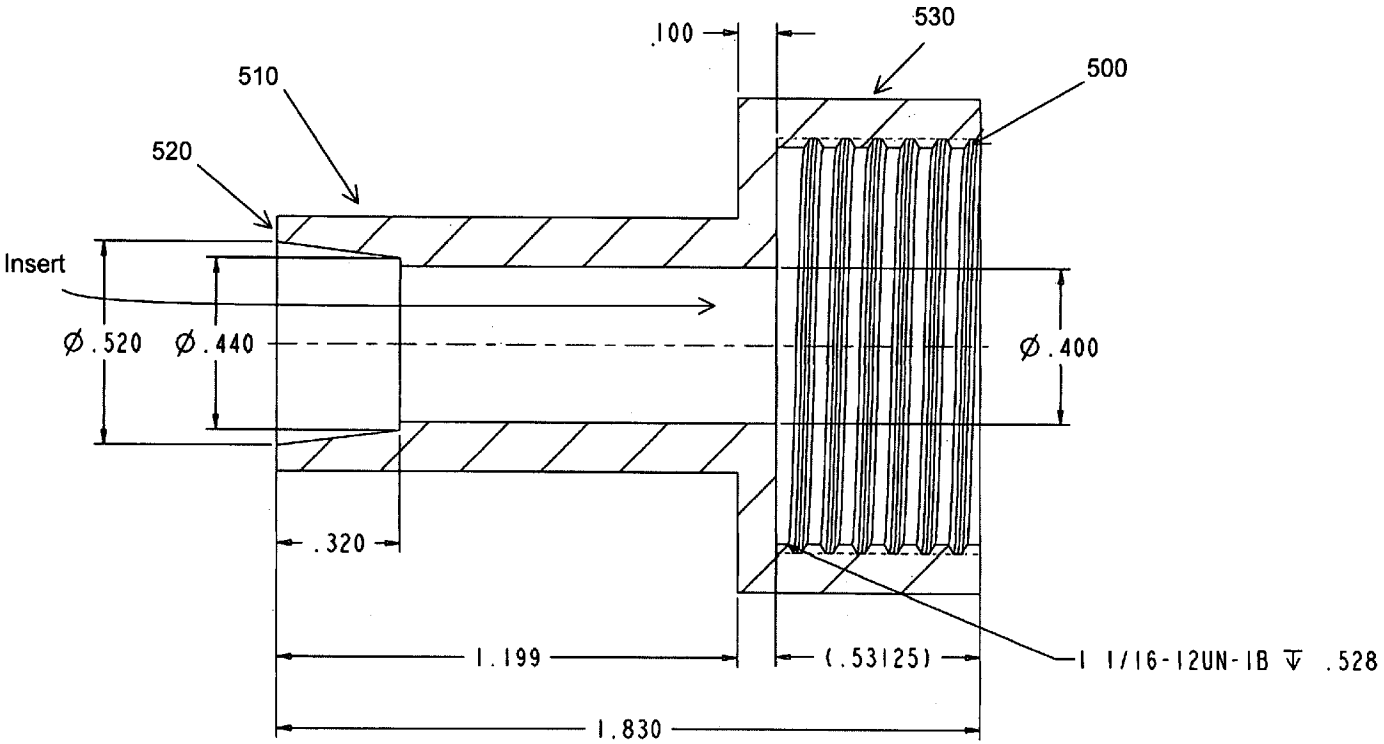
FIG. 5 illustrates an example adapter.

Referring to FIG. 5, an example of an adapter 510 is illustrated. The adapter 510 may be configured to facilitate connection to a booster/connector 500, as for example by including a portion 530 that interfaces with booster/connector 500 threads. The adapter 510 may have another portion 520 suitably configured for connecting with an ancillary device, such as ancillary devices D and/or E of FIG. 1. The example illustrated in FIG. 5 includes a threaded adapter 510 with a detonator retainer 520 (for example, for retaining a blasting cap) that may be screwed onto a booster/connector 500 and used as an initiation device to provide a means of inserting a blasting cap (as indicated by the arrow in FIG. 5) and initiating a module 300 or system. With an adapter 510 installed, the booster/connector 500 may be used as an initiation booster to initiate a module 300 from either the side or the end. It should be noted that the measurements illustrated in FIG. 5, which are in inches, are approximate measurements and represent only one example embodiment. Other measurements are contemplated, such as for use with different sized/shaped booster/connectors, different sized/shaped modules, and the like.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the specification there has been set forth example embodiments of the invention and, although specific terms are used, the description thus given uses terminology in a generic and descriptive sense only and not for purposes of limitation.

Finally, any numerical parameters set forth in the specification and attached claims are approximations (for example, by using the term "about") that may vary depending upon the desired properties sought to be obtained by the embodiments of the present invention. At the very least, and not as an attempt to limit the application of the doctrine of equivalents to the scope of the claims, each numerical parameter should at least be construed in light of the number of significant digits and by applying ordinary rounding.

What is claimed is:

1. An overpressure disrupter system, comprising:

at least one module;

an explosive material being contained in said at least one module;

a fire retardant material being contained in said at least one module, wherein said at least one module further comprises at least one connection area; at least one outer wall; and at least one inner wall, wherein said at least one outer wall and said at least one inner wall combine to form at least one outer compartment housing said fire retardant material, wherein said at least one inner wall forms at least one inner compartment housing said explosive material, and wherein said at least one connection area is configured to connect at least one of said at least one module with at least one of another of said at least one module, and at least one ancillary device; and an additional connection piece, wherein said additional connection piece is configured to connect at least two modules of said at least one module, and wherein said additional connection piece contains an explosive material therein.

2. The overpressure disrupter of claim 1, further comprising at least two modules being connected via said at least one connection area.

3. The overpressure disrupter of claim 1, further comprising an adapter being configured for connecting said additional connection piece and an ancillary device.

4. The overpressure disrupter of claim 1, further comprising at least one ancillary device being connected to said at least one module via said at least one connection area.

5. The overpressure disrupter of claim 4, wherein said at least one ancillary device comprises at least one of a detonator, a robotic handle, and a window breaker.

6. The overpressure disrupter of claim 1, wherein said fire retardant material is comprised of a fire retardant powder.

7. The overpressure disrupter of claim 1, wherein said fire retardant material is comprised of ammonium nitrate.

8. The overpressure disrupter of claim 1, wherein said at least one module is substantially cylindrical in shape.

9. The overpressure disrupter of claim 1, wherein said at least one connection area is comprised of six connector areas.

10. The overpressure disrupter of claim 1, wherein said at least one outer wall is comprised of a polycarbonate plastic.

11. The overpressure disrupter of claim 1, wherein said at least one inner wall is comprised of a polycarbonate plastic.

12. The overpressure disrupter of claim 1, wherein all of said at least one outer wall and said at least one inner wall are comprised a polycarbonate plastic.

13. An overpressure disrupter system, comprising:

at least two connectable modules;

explosive material being contained in said at least two connectable modules;

fire retardant powder being contained in said at least two connectable modules, wherein said at least two connectable modules are connected via standardized connection areas contained within each of said at least two connectable modules, and wherein said fire retardant powder is disposed within said at least two connectable modules to encompass, substantially, said explosive material, and a separation medium separating said explosive material and said fire retardant powder.

14. The overpressure disrupter system of claim 13, wherein said fire retardant powder comprises ammonium nitrate, and wherein said explosive material is selected from a group consisting of PBXN-11, PBXN-9, PBXN-114, and PBXW-115.

15. The overpressure disrupter system of claim 13, further comprising an ancillary device being selected from a group consisting of a detonator, a robotic handle, and a window breaker.

16. An over pressure disrupter system, comprising:

a series of connected modules being connected via a plurality of connection areas, wherein said series of connected modules each comprises an explosive charge substantially surrounded with a fire retardant material, and wherein said fire retardant material is substantially surrounded by a polycarbonate outer shell, and at least one detonator being connected to at least one of said plurality of connection areas; and, an additional connection piece, wherein said additional connection piece is configured to connect at least two modules, and wherein said additional connection piece contains an explosive material therein.

* * * * *